United States Patent [19]

Cooper et al.

[11] 4,182,009

[45] Jan. 8, 1980

[54] ELECTRICAL IGNITERS

[75] Inventors: Ronald H. Cooper, Claygate; Kenneth A. Goreham, London; Christopher B. Wakeford, Twickenham, all of England

[73] Assignee: Smiths Industries Limited, London, England

[21] Appl. No.: 885,246

[22] Filed: Mar. 10, 1978

[30] Foreign Application Priority Data

Mar. 11, 1977 [GB] United Kingdom ..... 10398/77

[51] Int. Cl.[2] ..... H01T 21/02

[52] U.S. Cl. ..... 29/25.12

[58] Field of Search ..... 313/141, 131 A, 138, 313/144; 29/25.12

[56] References Cited

U.S. PATENT DOCUMENTS

| | | | |
|---|---|---|---|
| 1,314,129 | 8/1919 | Crowther | 313/138 X |
| 1,360,294 | 11/1920 | Hill | 313/138 X |
| 2,029,669 | 2/1936 | Nowosielski | 313/144 X |
| 3,442,693 | 5/1969 | Rea | 29/25.12 |
| 3,882,338 | 5/1975 | Meyer | 313/141 X |
| 3,995,184 | 11/1976 | Insley | 29/25.12 |
| 4,028,576 | 6/1977 | Wofsey | 313/141 X |

*Primary Examiner*—Richard B. Lazarus

*Attorney, Agent, or Firm*—Pollock, Vande Sande & Priddy

[57] ABSTRACT

A surface-discharge igniter is formed by positioning a tubular assembly coaxially within the outer shell of a nose portion of the igniter. The assembly is welded about one end to form a seal with the outer shell, and glass material is placed within the assembly to form a seal with a central rod-shape electrode extending coaxially within the assembly. The assembly has an outer tube of the same material as the outer shell, and an inner tube which extends coaxially within the outer tube and which is of a different material, having a coefficient of thermal expansion substantially the same as that of the glass material. The inner tube is joined to the outer tube at an end remote from the seal with the outer shell. The nose portion forms the operative tip of the igniter and is welded to a rear body portion having screw threads for mounting the igniter and for making electrical connection to it.

12 Claims, 3 Drawing Figures

ELECTRICAL IGNITERS

BACKGROUND OF THE INVENTION

This invention relates to electrical igniters.

This invention is particularly concerned with methods of forming electrical igniters.

Electrical igniters usually have an outer electrode formed by a tubular metal shell, and an inner electrode formed by a metal rod extending coaxially within the shell. The inner and outer electrodes are separated from one another at an operative tip of the igniter by a small distance so as to define a path for electrical discharge between the electrodes; such path may be across an air-gap or over a semiconductive surface between the two electrodes at the operative tip. The inner electrode is insulated from the outer electrode along its length, the outer electrode being formed with a screw thread or similar formation, for use in mounting the igniter to the engine housing such that it extends through the wall of the combustion chamber with its operative tip located in the zone of combustion. External electrical connection to the two electrodes is made via an electrical connector which engages the ends of the electrodes remote from the operative tip and which is secured to the igniter by a screw-threaded retaining ring that engages with a co-acting thread on the outer electrode. When suitably high electrical energy is applied to the electrodes via the connector, discharge occurs between the electrodes at the operative tip thereby igniting any fuel-air mixture within the combustion chamber.

During manufacture of such igniters it is important that a pressure-tight seal is formed between the two electrodes in order to prevent leakage from the combustion chamber of the engine. In such igniters, typical faults experienced during testing following manufacture, are, an incorrectly functioning spark gap, commonly due to a faulty semiconductor pellet, and leakage through the seals between the electrodes which are particularly susceptible to temperature changes. A proportion of igniters tested show either or both of these faults and must consequently be rejected. This is very expensive, since the entire igniter, which may typically be sixteen centimeters long, must be rejected, it being very difficult to salvage any of its component parts for re-use.

Another disadvantage of the previous form of igniter is that, because of the different configurations of many engine housings, igniters for different engines require igniter bodies having different outer shapes and sizes so as correctly to fit the appropriate engine. This entails a large financial outlay by the manufacturer in order to keep adequate stocks of each of the different configurations of igniters to satisfy any expected demand for igniters for use with different engines. Expensive changes of equipment are also required when manufacturing igniters for different engines.

BRIEF SUMMARY OF THE INVENTION

It is an object of the present invention to provide a method of manufacturing an igniter, that alleviates to a substantial extent the above mentioned difficulties and disadvantages.

According to the present invention there is provided a method of forming an electrical igniter including first and second electrodes separated from one another to define an electrical discharge path between them, wherein a nose portion is formed having an outer shell containing a seal between the said first and second electrodes, an igniter body portion is formed having an outer shell, and wherein the said nose portion is joined with the said body portion such that the outer shells of the said nose portion and body portion together provide a composite outer shell of the igniter.

The method of forming an igniter according to the present invention allows for testing of both the discharge path and the seal between the electrodes, before the nose portion and the body portion are joined together. Thus, if either is faulty, the nose portion only need be rejected. The form of the nose portion may be common to several different igniters and therefore the manufacturer need only stock a small number of nose portions, fitting these to the appropriate body portion for each engine as required.

The first electrode may include a rod-shape portion extending coaxially within the outer shell of the nose portion, the second electrode being formed as part of the outer shell of the nose portion, and the seal between the first and second electrodes being formed by positioning a tubular assembly coaxially within the outer shell of the nose portion, sealing the tubular assembly to the inner surface of the outer shell of the nose portion, and forming a seal between an inner surface of the tubular assembly and the surface of the rod-shape portion. The tubular assembly may comprise an inner and outer tube mounted coaxially with one another; the tubular assembly may be sealed to the outer shell of the nose portion by sealing the outer tube at one end to the outer shell, and the inner tube may be sealed to the outer tube at an end remote from the seal with the outer shell.

The seal between the tubular assembly and the rod-shape portion may be formed by forming a firmly adherent oxide layer on both the inner surface of the inner tube and the surface of the rod-shape portion, introducing a glass material between the rod-shape portion and the inner tube, and forming from the glass material a glass seal that is firmly adherent to both the oxide layers.

The inner and outer tube may be separated from one another along a part of their length by an annular recess.

The inner tube may have a coefficient of thermal expansion substantially the same as that of the glass material, and the outer tube may have a coefficient of thermal expansion substantially the same as that of the outer shell of the nose portion.

It has been found that seals formed in accordance with the present invention are considerably less susceptible than previous seals to leakage and damage caused by temperature changes.

An igniter, and a method of forming an igniter, in accordance with the present invention, will now be described, by way of example, with reference to the accompanying drawings.

DETAILED DESCRIPTION

Figure 1:
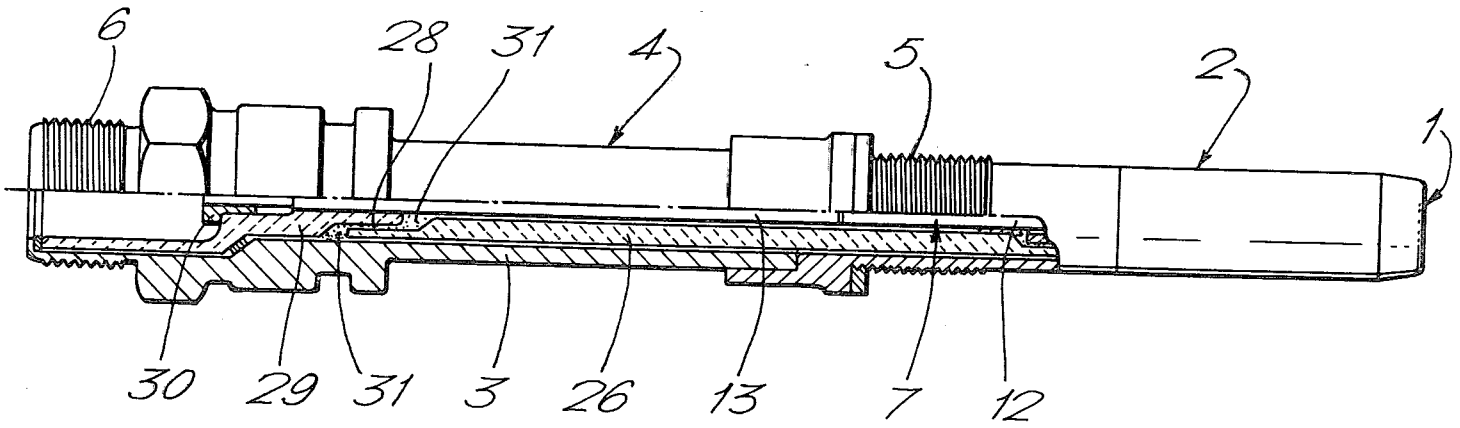
FIG. 1 is a partly sectional-view of the complete igniter.
Figure 2:
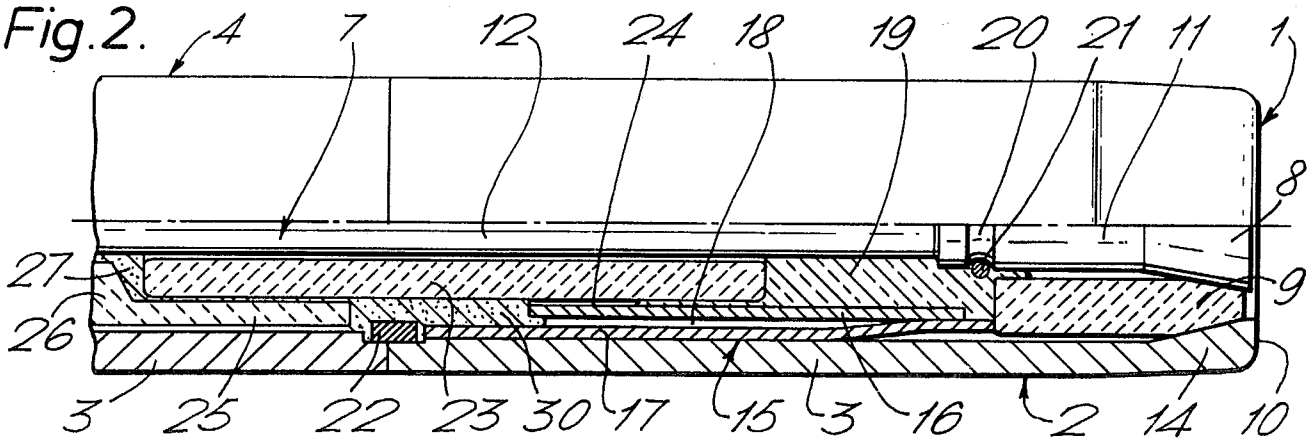
FIG. 2 is an enlarged view, partly in section, of a nose portion of the igniter of FIG. 1.

Referring particularly to FIGS. 1 and 2, the operative tip 1 of the igniter is located at the forward end of a substantially-cylindrical nose portion 2 of a composite tubular nimonic-alloy shell 3 that provides the external surface of the igniter, the nose portion 2 being about 3.5 cm long and 1.2 cm in diameter. The shell 3 rearwards of the nose portion 2 constitutes the shell of a body portion 4 of the igniter and is formed with two screw threads 5 and 6 that are for use, respectively, in mounting the igniter on the housing of an engine combustion chamber and in establishment of electrical connection with it at its rear end.

A metal rod 7, which is electrically insulated from the shell 3, extends coaxially of the shell 3 and is flared outwardly at the tip 1 to form a central electrode 8. At the tip 1, the central electrode 8 is separated across the exposed semiconductive surface of an annular pellet 9 from an annular end face or outer electrode surface 10 of the shell 3 of the nose portion 2, so as to form the required surface-discharge path between the rod 7 and the shell 3 at the operative tip 1.

The rod 7 is formed of a forward portion 11, an intermediate portion 12 and a rear portion 13. The forward portion 11, which includes the central electrode 8, is of a tungsten alloy and extends rearwardly from the tip 1 of the nose portion 2 to about midway along its length. The intermediate portion 12 is of a nickel, cobalt and iron alloy and is welded to the rear end of the forward portion 11, extending rearwardly out of the nose portion 2 and into the body portion 4 to about midway along the length of the igniter. The rear portion 13 is likewise of a nickel, cobalt and iron alloy and is welded to the rear end of the intermediate portion 12, extending rearwardly within the body portion 4 to within a short distance of the rear end of the igniter.

The construction of the igniter will now be described in more detail. In particular, with reference to FIG. 2, the annular pellet 9 is of a semiconductive ceramic material and has a tapering forward end which abuts, on its inner surface, the flared part of the forward portion 11 of the rod 7, and, on its outer surface, a tapering portion 14 at the forward end of the shell 3. The pellet 9 has a ring-shaped semiconducting surface which is slightly inset from the end face 10 of the shell 3 and the central electrode 8.

A tubular assembly 15 is located coaxially within the shell 3 abutting the rear end of the pellet 9 and extending rearwardly from the pellet in contact, along the rear part of its length, with the inner surface of the shell 3. The tubular assembly 15 comprises an inner tube 16 of a nickel, cobalt and iron alloy and an outer coaxial tube 17 of nimonic-alloy. The forward end of the outer tube 17 tapers to a reduced diameter and abuts the forward end of the inner tube 16 to which is it welded, thereby forming an annular recess 18 between the two tubes 16 and 17. The outer tube 17 is welded about its rear end only to the inner surface of the shell 3, the rear end of the inner tube 16 being spaced a short distance forward from the end of the outer tube 17 to avoid damage to the inner tube during welding.

Rearwardly of the pellet 9, there is an annular recess between the rod 7 and the tubular assembly 15, the recess being filled by a seal 19 of glass material. The glass material is firmly adherent to thin oxide layers formed on the surface of both the inner tube 16 and the forward end of the intermediate portion 12 of the rod 7, so as thereby to form a seal between them.

The forward portion 11 of the rod 7 has an annular channel 20 in its surface close to its rear end, in which is located a circlip 21 that prevents the forward portion 11 dropping from the igniter into the engine combustion chamber if the forward portion 11 should become detached from the remainder of the rod 7.

The rear end of the nose portion 2 of the shell 3 abuts and is welded to the forward end of the body portion 4 of the shell, with the welded ends embracing a stainless-steel collar 22 that aids location of the body portion 4 with the nose portion 2 during welding.

A ceramic sleeve 23 embraces the intermediate portion 12 of the rod 7 and projects rearwardly from the nose portion 2 of the shell 3. The sleeve 23 projects within the tubular assembly 15 forming an annular recess 24 between the outer surface of the sleeve 23 and the inner surface of the inner tube 16, the recess 24 being filled with the glass material forming the seal 19, and thereby securing the sleeve 23 in position.

The rear end of the sleeve 23 is in turn embraced by a forward cuffed-portion 25 of a ceramic tube 26. Gaps between the sleeve 23 and the tube 26 are filled with a heat-resistant cement 27 which also fills any space between the sleeve 23 and the shell 3 in the region of the welded joint. The tube 26 also has a rear cuffed-portion 28 (FIG. 1) which embraces a forward end of a funnel-shape ceramic contact insulator 29. The contact insulator 29 supports the rear end of the rod 7 which has a contact bushing 30 welded to it. The contact bushing 30 is for engagement by an electrical connector which serves also to establish an earth or ground connection with the shell 3. A silicone elastomer material 31 fills gaps between the ends of the contact insulator 29 and the tube 26 to provide resilience between them.

The materials and the arrangements of the components of the nose portion 2 of the igniter have been carefully chosen to avoid stresses caused by thermal expansion due to the high temperatures experienced by the nose portion 2. In particular, both the intermediate portion 12 of the rod 7 and the inner tube 16 have a coefficient of thermal expansion that is closely matched to that of the material of the glass seal 19 adherent to the oxide layers formed on them, whereas the outer tube 17 has the same coefficient of thermal expansion as that of the shell 3. Since the inner tube 16 is secured to the outer tube 17 at one end only, differential thermal expansion between these two tubes will not cause any excessive stress.

The annular recess 18 between the inner tube 16 and the outer tube 17 forms an air-gap which permits limited radial displacement upon thermal expansion and also acts as a thermal-insulating barrier damping the effect of any sudden changes in temperature at the outer surface of the igniter.

Figure 3:
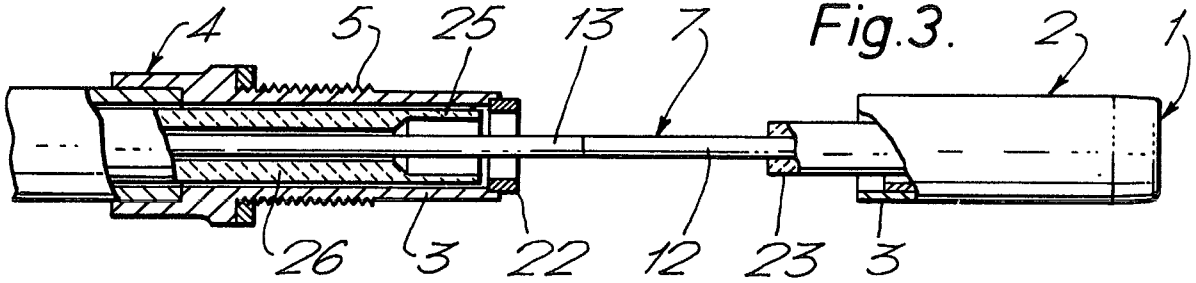
FIG. 3 is a partly sectional-view of the nose portion and a part of the body portion, illustrating a preliminary stage of manufacture of the igniter of FIG. 1.

The complete igniter described above is formed in two parts, as can most clearly been seen in FIG. 3, the nose portion 2, which is a completely sealed unit capable of withstanding the high temperatures and rapid temperature changes experienced at the operative tip of the igniter, and the body portion 4 which provides the screw threads for mounting the igniter and for making electrical connection with it.

Prior to assembly of the nose portion 2, the oxide layers are formed on the inner tube 16 of the tubular assembly 15 and on the intermediate portion 12 of the rod 7 by heating the components at about 1050° C. in wet hydrogen to remove carbon from the surface layer, and subsequently heating in an oxidising atmosphere at about 600° C. to produce a thin oxide layer.

The semiconductive pellet 9 is inserted into the forward end of the nose portion 2 of the shell 3 and the tubular assembly 15 is pushed into the shell 3 to abut the rear of the pellet 9. The outer tube 17 is then welded about its rear end to the shell 3 to form an hermetic seal.

The forward and intermediate portions 11 and 12 of the rod 7, welded together, are inserted from the forward end of the nose portion 2 to extend through the pellet 9 such that the surface of the electrode 8 is almost flush with the end face 10. The circlip 21 is then fitted into the annular channel 20 and glass pellets are placed within the recess between the rod 7 and the inner tube 16. The ceramic sleeve 23 is pushed over the rod 7 from the rear end of the nose portion 2 and the glass pellets are heated to bring them to a molten state while the sleeve 23 is urged forwards into the molten glass such that the glass flows into the annular recess 24 between the sleeve 23 and the inner tube 16. The glass is allowed to cool and solidify to form the glass seal 19 between the rod 7 and the tubular assembly 15, thereby completing assembly of the nose portion 2.

The nose portion 2 is joined to the body portion 4 by welding the intermediate portion 12 of the rod 7 to the rear portion 13, and then pushing the body portion 4 of the shell 3, together with the collar 22, over the rod 7 and into abutment with the rear end of the nose portion 2 of the shell 3. The two parts of the shell 3 are then joined together by electron-beam welding to form the composite outer shell of the igniter. The cement 27 is introduced into the space between the sleeve 23 and the shell 3, and the tube 26 is inserted in the shell from the rear end such that the cuffed portion 25 embraces the rear end of the sleeve 23, the cement 27 being squeezed between the tube 26 and the sleeve 23 to secure them together. The silicone elastomer material 31 is then inserted into the rear end of the tube 26, the contact insulator 29 is fixed in position at the rear end of the body portion 4, and the contact bush 30 is welded to the rear end of the rod 7, projecting through the contact insulator 29, thereby to complete assembly of the igniter.

We claim:

1. A method of forming an electrical igniter comprising the steps of:

(a) forming a first electrode including a rod-shaped portion;

(b) forming a second electrode in the form of an outer shell of said igniter;

(c) mounting said rod-shaped portion to extend coaxially within said outer shell with said first and second electrodes being separated from one another by an electrical discharge path;

(d) forming a tubular assembly by positioning an inner tube to extend coaxially within an outer tube and joining said inner tube to said outer tube at one end only, with said inner tube and said outer tube separated from one another along a part of their length; and (e) forming a seal between said first and second electrodes by positioning said tubular assembly to extend coaxially within said outer shell, sealing an end of said outer tube remote from said one end with said outer shell, and forming a seal of glass material between the inner surface of said inner tube and the surface of said rod-shaped portion of said first electrode.

2. A method of forming an electrical igniter comprising the steps of:

(a) forming a first electrode including a rod-shaped portion;

(b) forming a second electrode in the form of an outer shell of said igniter;

(c) mounting said rod-shaped portion to extend coaxially within said outer shell with said first and second electrodes being separated from one another by an electrical discharge path;

(d) forming a tubular assembly by positioning an inner tube of one material to extend coaxially within an outer tube of a different material and joining said inner tube to said outer tube at one end only; and (e) forming a seal between said first and second electrodes by positioning said tubular assembly to extend coaxially within said outer shell, sealing an end of said outer tube remote from said one end with said outer shell, and forming a seal of glass material between the inner surface of said inner tube and the surface of said rod-shaped portion of said first electrode.

3. A method of forming an electrical igniter according to claim 2, wherein said outer tube has a coefficient of thermal expansion substantially the same as that of said outer shell, such that stresses in the igniter due to thermal expansion are substantially relieved.

4. A method of forming an electrical igniter according to claim 3, wherein said outer tube is of the same material as that of said outer shell.

5. A method of forming an electrical igniter according to claim 4 wherein said outer tube and said outer shell are both of a nimonic alloy.

6. A method of forming an electrical igniter according to claim 1 or claim 2 wherein said seal between the inner surface of said inner tube and the surface of said rod-shaped portion is formed by: forming a first firmly adherent oxide layer on the inner surface of said inner tube, forming a second firmly adherent oxide layer on the surface of said rod-shaped portion, introducing said glass material between said rod-shaped portion and said inner tube, and forming from the glass material a glass seal that is firmly adherent to both said first and second oxide layers.

7. A method of forming an electrical igniter according to claim 1 or claim 2, wherein said inner tube has a coefficient of thermal expansion substantially the same as that of said glass material, such that stresses in the igniter due to thermal expansion are substantially relieved.

8. A method of forming an electrical igniter according to claim 7 wherein said inner tube is of a nickel, cobalt and iron alloy.

9. A method of forming an electrical igniter according to any one of claims 5, 1, 2, 3, or 4 including an annular element, said annular element being located within an end of said outer shell, said annular element having an electrically semiconductive surface, and said first electrode extending through said annular element such that said semiconductive surface provides said electrical discharge path.

10. A method of forming an electrical igniter according to claim 9 wherein said first electrode has a flared end, said second electrode has a tapered inner surface, and wherein said annular element has a tapered end that abuts said flared end of said first electrode and said tapered inner surface of said second electrode such as to retain said annular element in said outer shell.

11. A method of forming an electrical igniter including a first electrode and a second electrode, said first electrode being of a rod-shape, said second electrode being in the form of a first outer shell, and said first and second electrodes being separated from one another by an electrical discharge path, comprising the steps of:

(a) assembling a nose portion by forming a tubular assembly by sealing an inner tube with an outer tube at a first end such that said inner tube extends coaxially within said outer tube, with said inner tube and said outer tube separated from one another along a part of their length;

(b) positioning said tubular assembly coaxially within the second electrode;

(c) sealing said outer tube at a second end remote from said first end with said second electrode;

(d) positioning an annular element within said second electrode, said annular element having a semiconductive surface to define said electrical discharge path;

(e) positioning said first electrode to extend coaxially within said second electrode, said tubular assembly and said annular element being so arranged that said first and second electrodes are separated at an end by said semiconductive surface;

(f) introducing a glass material between said first electrode and said inner tube;

(g) forming from the glass material a glass seal that is firmly adherent to both said inner surface of said inner tube and the surface of said first electrode thereby to form a seal between said first electrode and said second electrode;

(h) forming a body portion including a second outer shell, said second outer shell having means for mounting said igniter; and (i) joining said body portion with said nose portion by joining said first and second outer shells together to form a composite outer shell of the igniter.

12. A method of forming an electrical igniter including a first electrode and a second electrode, said first electrode being of a rod-shape, said second electrode being in the form of a first outer shell, and said first and second electrodes being separated from one another by an electrical discharge path, comprising the steps of:

(a) assembling a nose-portion by forming a tubular assembly by sealing an inner tube of one material with an outer tube of a different material at a first end such that said inner tube extends coaxially within said outer tube, said inner tube having a coefficient of thermal expansion substantially the same as that of said second electrode;

(b) positioning said tubular assembly coaxially within the second electrode;

(c) sealing said outer tube at a second end remote from said first end with said second electrode;

(d) positioning an annular element within said second electrode, said annular element having a semiconductive surface to define said electrical discharge path;

(e) positioning said first electrode to extend coaxially within said second electrode, said tubular assembly and said annular element being so arranged that said first and second electrodes are separated at an end by said semiconductive surface;

(f) introducing a glass material between said first electrode and said inner tube, said glass material having a coefficient of thermal expansion substantially the same as that of said inner tube;

(g) forming from the glass material a glass seal that is firmly adherent to both said inner surface of said inner tube and the surface of said first electrode such as thereby to form a seal between said first electrode and said second electrode;

(h) forming a body portion including a second outer shell, said second outer shell having means for mounting said igniter; and (i) joining said body portion with said nose portion by joining said first and second outer shells together to form a composite outer shell of the igniter.

* * * * *